US007370620B1

(12) United States Patent
Nino et al.

(10) Patent No.: US 7,370,620 B1
(45) Date of Patent: May 13, 2008

(54) INTAKE MANIFOLD ASSEMBLY HAVING SHORT COMPACT RUNNERS AND METHODS OF MAKING SAME

(75) Inventors: J. Carlos Nino, Dearborn, MI (US); Robert Prisk, Livonia, MI (US); Marcello Tedesco, Saline, MI (US); John S. Frait, Ann Arbor, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 102 days.

(21) Appl. No.: 11/400,727

(22) Filed: Apr. 7, 2006

Related U.S. Application Data

(60) Provisional application No. 60/669,149, filed on Apr. 7, 2005.

(51) Int. Cl.
*F02M 35/10* (2006.01)

(52) U.S. Cl. ..... 123/184.32; 123/184.47

(58) Field of Classification Search ..... 123/184.32, 123/184.33, 184.34, 184.42, 184.43, 184.44, 123/184.47, 184.48, 184.49
See application file for complete search history.

(56) References Cited

U.S. PATENT DOCUMENTS

| | | | | |
|---|---|---|---|---|
| 4,440,120 | A | 4/1984 | Butler | |
| 5,890,464 | A * | 4/1999 | Martinelli | 123/184.21 |
| 6,408,809 | B2 * | 6/2002 | Suzuki | 123/184.31 |
| 6,467,449 | B2 | 10/2002 | Brassell et al. | |

FOREIGN PATENT DOCUMENTS

JP 09166056 A * 6/1997

* cited by examiner

*Primary Examiner*—Noah P. Kamen
(74) *Attorney, Agent, or Firm*—MacMillan, Sobanski & Todd, LLC

(57) ABSTRACT

An air intake manifold assembly for use with an internal combustion engine includes a plenum portion and a runner assembly mounted to the plenum portion. The runner assembly has a flange disposed between an air intake portion and an air outlet portion.

16 Claims, 2 Drawing Sheets

INTAKE MANIFOLD ASSEMBLY HAVING SHORT COMPACT RUNNERS AND METHODS OF MAKING SAME

CROSS REFERENCE TO RELATED APPLICATIONS

This application claims the benefit of U.S. Provisional Application No. 60/669,149 filed Apr. 7, 2005.

Inventors: J. Carlos Nino, Robert Prisk, Marcello Tedesco, and John S. Frait.

BACKGROUND OF THE INVENTION

The present invention relates in general to vehicle engines and in particular to an improved air intake manifold assembly for use in such a vehicle engine and method for producing the same.

An air intake manifold assembly of a multi-cylinder engine includes a plurality of branched air passageways or ducts. Each of the air passageways defines a generally tubular runner having an air intake port and an opposite air outlet port. The air intake port of the runner is connected to an associated plenum which supplies atmospheric, turbo, or supercharged air to the runner intake port, and the air outlet port is connected to a flange which is connected to an associated inlet port of each cylinder head of the engine to supply the air from the runner to each cylinder head. Conventional intake manifold assemblies are constructed of cast iron, magnesium, aluminum, and plastic.

A typical aluminum intake manifold assembly is produced entirely by conventional casting process. These manifolds typically include a plurality of tubes disposed having first ends connected with the outlet holes of an air intake plenum, and second opposite ends connected with the associated holes of a flange member which is adapted for mounting to a cylinder head of the engine.

A typical plastic multi-piece manifold assembly includes an upper half shell and a lower half shell which are joined together by a welding process. In some instances, the plastic multi-piece manifold assembly includes one or more inner shell pieces which are disposed within the upper and/or lower half shells. The inner shell can be lower partial inserts which are secured to lower half shell; upper partial inserts which are secured to the upper half shell, or both lower and upper partial inserts which are secured to the respective lower and upper half shells. The inserts are typically joined to the associated half shell by a conventional heat staking process or welding process. In some instances, a plurality of individual blow molded tubes is disposed within the upper and lower half shells and joined thereto by a conventional heat staking process. In both types of constructions, the inserts, or the inserts in cooperation with upper or lower half shells, define a corresponding number of runner paths through which air is supplied to the associated cylinder head of the engine.

One example of a two-piece intake manifold is disclosed in U.S. Pat. No. 4,440,120 to Butler. Butler discloses an upper shell section and a lower shell section with each section containing at least partial portions of the air runner ducts that lead to the individual engine intake valves. Both the upper and lower shell sections tend to be of the same material, typically a polymer or aluminum, but can be of different materials.

Another example of a multi-piece intake manifold is disclosed in U.S. Pat. No. 6,467,449 to Brassell et al.

Brassell et al. disclose simplified upper and lower shell sections by transferring some of the runner complexity to an insert assembly mounted internal to the upper and lower shell sections. The insert assembly is most likely to be of a polymer material.

SUMMARY OF THE INVENTION

The present invention relates to an improved air intake manifold assembly for use with an internal combustion engine and method for manufacturing the same.

The air intake manifold assembly includes a plenum portion and a runner assembly mounted to the plenum portion. The runner assembly has a flange disposed between an air intake portion and an air outlet portion.

Other aspects of this invention will become apparent to those skilled in the art from the following detailed description of the invention, when read in light of the accompanying drawings.

DETAILED DESCRIPTION OF THE INVENTION

Figure 1:
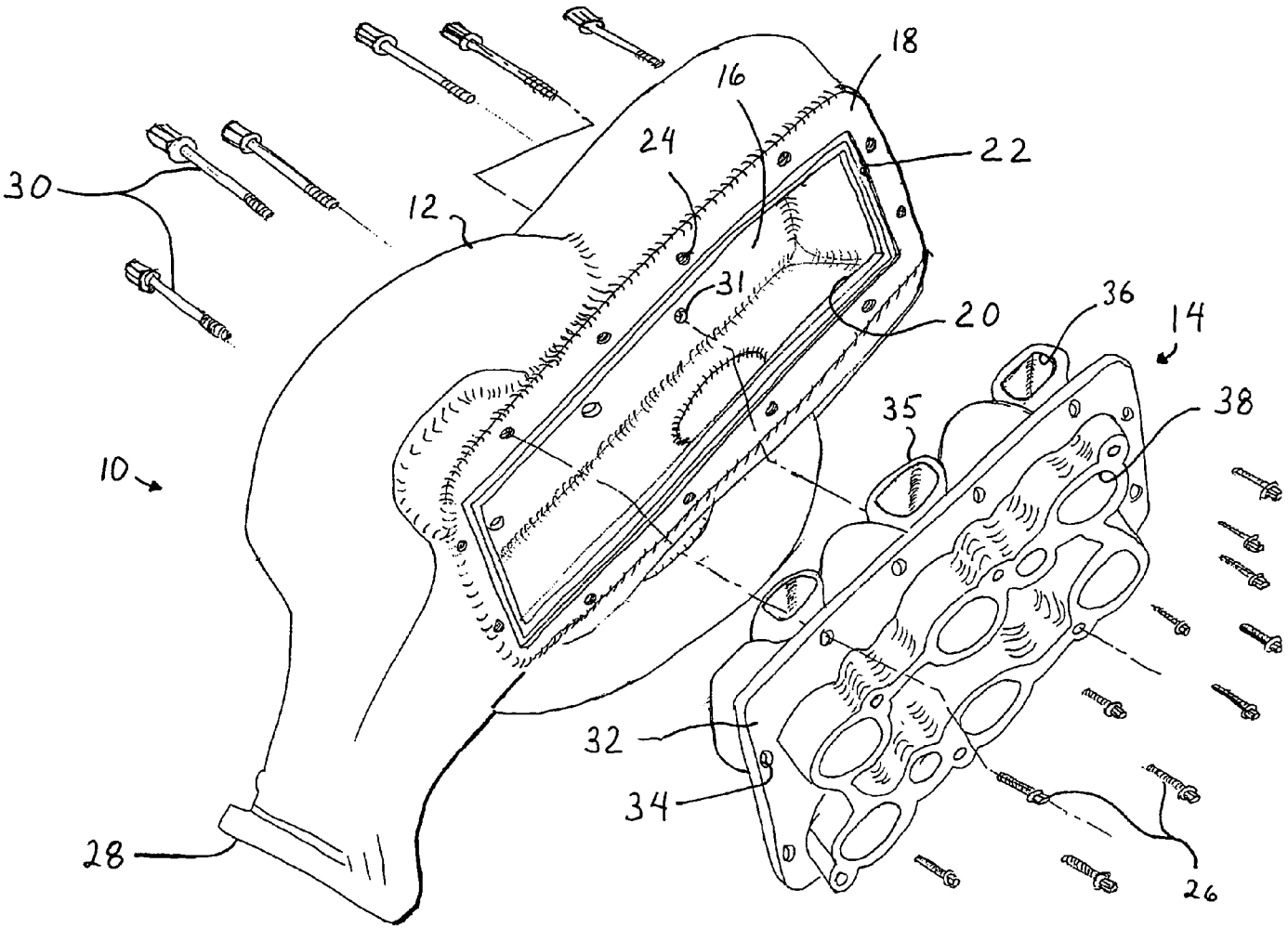
FIG. 1 is a perspective view of a first embodiment of an intake manifold assembly.

Referring now to the drawings, there is illustrated in FIG. 1 a perspective view of a first embodiment of an air intake manifold assembly, indicated generally at 10. The intake manifold assembly 10 shown in this embodiment is for use with a six-cylinder engine and includes a plenum portion 12 and a runner assembly 14. As will be discussed below, the plenum portion 12 and the runner assembly 14 are joined together and sealed by a suitable process to produce the intake manifold assembly 10 in accordance with this invention.

The plenum portion 12 may be formed of metal. Suitable such metal material includes aluminum, magnesium, and alloys thereof. Alternatively, other suitable materials, such as other metals, alloys thereof, and non-metals can be used.

Although the intake manifold assembly 10 illustrated and described herein is for use with a six-cylinder engine application, it will be appreciated that the invention can be used in conjunction with other types of engines. For example, the manifold assembly 10 can be used in connection with an inline 4 cylinder engine (I-4) and a V-8 cylinder engine.

In the embodiment illustrated in FIG. 1, the plenum portion 12 includes a chamber 16. The plenum portion 12 further includes a runner-mounting surface 18 having a first or plenum opening 20 formed in the plenum portion 12. The first runner-mounting surface 18 is adapted to be connected to the runner assembly 14, as will be explained in detail below. In the illustrated embodiment, a sealant groove 22 is formed in the runner-mounting surface 18 about the plenum opening 20. Fluid sealing means (not shown), such as an O-ring or a gasket, may be disposed in the sealant groove 22. Alternatively, other suitable sealing means or materials can be used. The sealing means is effective to provide a fluid tight seal between the plenum portion 12 and the runner assembly 14.

The runner-mounting surface 18 includes a plurality of first mounting holes 24. The mounting holes 24 are adapted to receive a suitable fastener, such as a threaded first fastener 26, for securing the runner assembly 14 to the plenum portion 12. Alternatively, the runner assembly 14 may be secured to the plenum portion 12 by other suitable means, such as with an adhesive or with steel snap clips. Such snap clips may be inserted into a groove (not shown) formed in an exterior surface of the plenum portion 12 and an adjacent groove (not shown) formed in an exterior surface of the runner assembly 14.

In the illustrated embodiment, a first flange 28 is formed in the plenum portion 12 and has an opening (not shown) formed therein. The first flange 28 is adapted to be connected to a throttle body (not shown) and the opening defined by the first flange 28 functions as an air intake port to supply atmospheric air to the chamber 16.

The illustrated runner assembly 14 includes a second flange 32 adapted to be connected to the first runner-mounting surface 18 of the plenum portion 12. The second flange 32 includes a plurality of third mounting holes 34. The mounting holes 34 are adapted to receive a suitable fastener, such as the threaded first fastener 26, for securing the runner assembly 14 to the plenum portion 12.

The illustrated plenum portion 12 further includes a plurality of second mounting holes 31, in a surface of the plenum portion opposite the plenum opening 20. The mounting holes 31 are adapted to receive a suitable fastener, such as the threaded second fastener 30, for securing the second flange 32 of the intake manifold assembly 10 to a flange (not shown) of the cylinder heads (not shown) of an engine (not shown), thereby connecting each of a plurality of runners 35 of the manifold assembly 10 to a respective inlet of each cylinder head.

The illustrated runner assembly 14 includes six generally tubular shaped runners 35. Each runner 35 includes a first runner portion or air intake port 36 and a second runner portion or air outlet port 38. The outlet ports 38 are adapted to be connected to an associated inlet port of each cylinder head of the engine to supply air from a respective one of the runners 35 to an associated cylinder. The illustrated runners 35 are shown having a substantially round or oval transverse section. Alternatively, the runners 35 may have any other desired shape, such as runners having a substantially rectangular or other polygonal transverse section.

The runner assembly 14 may be formed from a suitable polymer. Such a suitable polymer is glass reinforced nylon. Alternatively, other suitable materials such as unreinforced nylon, mineral reinforced nylon, and other polymers, metals and alloys thereof, can be used.

Figure 2:
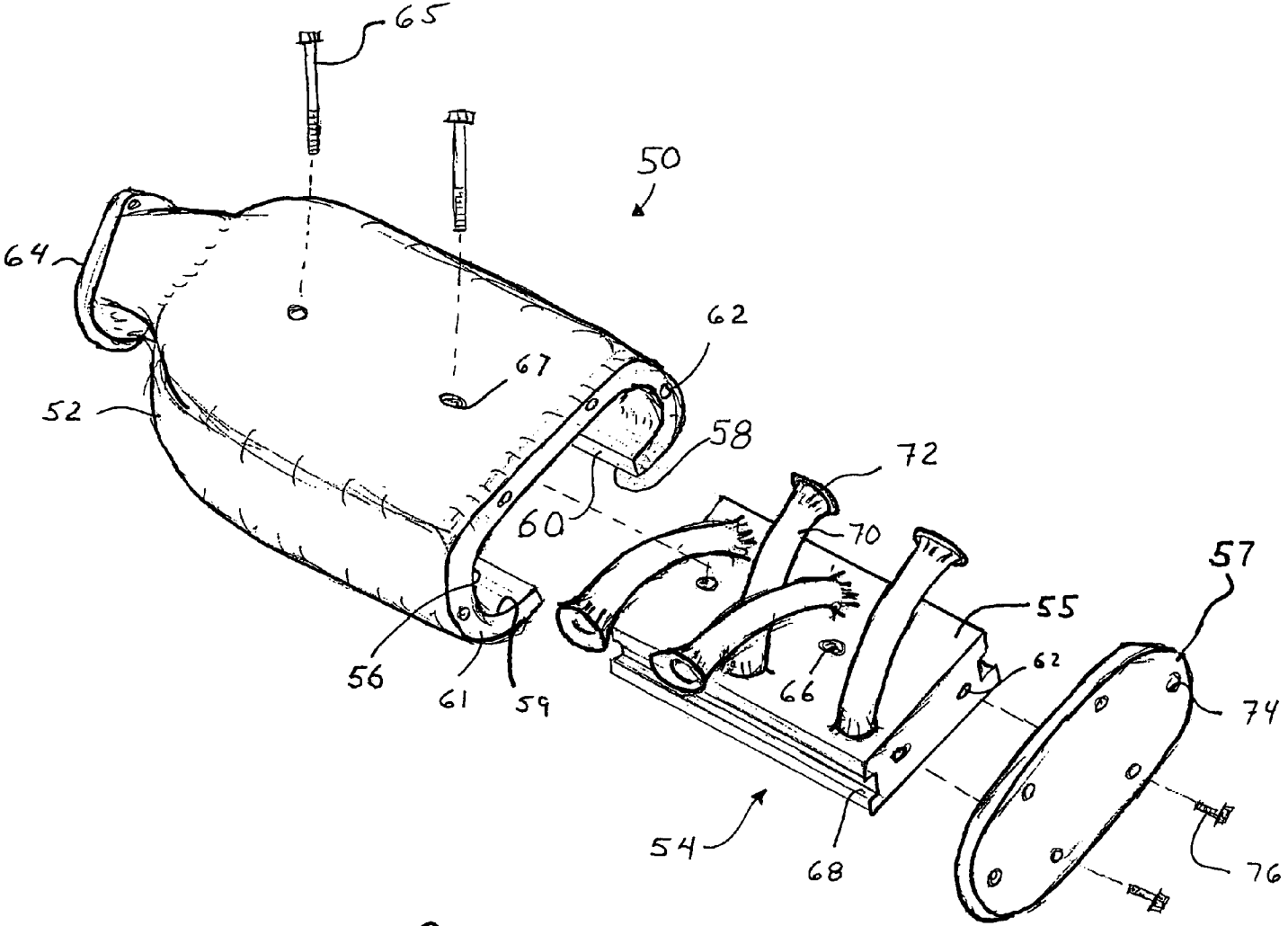
FIG. 2 is a perspective view of a second embodiment of an intake manifold assembly.

Referring now to FIG. 2, there is illustrated a perspective view of a second embodiment of an air intake manifold assembly, indicated generally at 50. The intake manifold assembly 50 shown in this embodiment is for use with a four-cylinder engine and includes a plenum portion 52, a runner assembly 54, and an end plate 57. As will be discussed below, the plenum portion 52, the runner assembly 54, and the end plate 57 are joined together and sealed by a suitable process to produce the intake manifold assembly 50 in accordance with this invention.

The plenum portion 52 may be formed of metal. Suitable such metal material includes aluminum, magnesium, and alloys thereof. Alternatively, other suitable materials, such as other metals, alloys thereof, and non-metals can be used.

Although the intake manifold assembly 50 illustrated and described herein is for use with a four-cylinder engine application, it will be appreciated that the invention can be used in conjunction with other types of engines. For example, the manifold assembly 50 can be used in connection with a standard six-cylinder engine, a V-6 cylinder engine, and a V-8 cylinder engine.

In the embodiment illustrated in FIG. 2, the plenum portion 52 includes a chamber 56. The plenum portion 52 further includes a first plenum opening 58 defining a first or runner-receiving surface 60. The runner-receiving surface 60 is adapted to be connected to the runner assembly 54, as will be explained in detail below. The illustrated plenum portion 52 includes a second plenum opening 59 defining a second surface 61. The surface 61 includes a plurality of first mounting holes 62. The mounting holes 62 are adapted to receive a suitable fastener, such as the threaded second fastener 76, for securing the end plate 57 to the plenum portion 52.

In the illustrated embodiment, a flange 64 is formed in the plenum portion 52 and has an opening (not shown) formed therein. The flange 64 is adapted to be connected to a throttle body (not shown) and the opening defined by the flange 64 functions as an air intake port to supply atmospheric air to the chamber 56.

The illustrated runner assembly 54 includes a flange portion 55, and a pair of slide grooves 68 adapted to slidingly engage the runner-receiving surface 60 of the plenum opening 58 of the plenum portion 52. The runner assembly 54 includes a plurality of third mounting holes 66. The mounting holes 66 are adapted to receive the fasteners 65. The runner assembly 54 also includes a plurality of the first mounting holes 62. The mounting holes 62 of the runner assembly 54 are adapted to receive the threaded second fasteners 76, for securing a portion of the end plate 57 to the runner assembly 54.

The illustrated plenum portion 52 further includes a plurality of second mounting holes 67 in a surface of the plenum portion 52 opposite the plenum opening 58. The mounting holes 67 are adapted to receive a suitable fastener, such as the threaded first fastener 65, for securing the intake manifold assembly 50 to a flange (not shown) of the cylinder heads (not shown) of an engine (not shown), thereby connecting each of a plurality of runners 70 of the manifold assembly 50 to a respective inlet of each cylinder head.

The illustrated runner assembly 54 includes four generally tubular shaped runners 70. Each runner 70 includes an outwardly extending first runner portion or air intake port 72 and a second runner portion or air outlet port (not shown, but downwardly facing as viewed in FIG. 2). The outlet ports are adapted to be connected to an associated inlet port of each cylinder head of the engine to supply air from a respective one of the runners 70 to an associated cylinder. It will be understood that the air outlet ports may be defined by openings in the downwardly facing surface (as viewed in FIG. 2) of the flange portion 55. Alternatively, the air outlet ports may be defined by a plurality of outwardly extending air outlet ports.

The illustrated runners 70 are shown having a substantially round or oval transverse section. Alternatively, the runners 70 may have any other desired shape, such as runners having a substantially rectangular or other polygonal transverse section.

The runner assembly 54 may be formed from a suitable polymer. Such a suitable material is glass reinforced nylon. Alternatively, other suitable materials such as unreinforced nylon, mineral reinforced nylon, and other polymers, metals and alloys thereof, can be used.

The illustrated end plate 57 is substantially flat and includes a plurality of fourth mounting holes 74. The mounting holes 74 are adapted to receive a suitable fastener, such as the threaded second fastener 76, for securing the end plate 57 to the plenum portion 52 and to the runner assembly 54.

The end plate 57 may be formed from a suitable polymer. Such a suitable material is glass reinforced nylon. Additionally, other suitable materials such as unreinforced nylon, mineral reinforced nylon, and other polymers can be used. Alternatively, the end plate 57 formed of metal. Such suitable material is aluminum or magnesium. Alternatively, other suitable materials, such as other metals, alloys thereof, and non-metals can be used.

Fluid sealing means (not shown), such as an O-ring or a gasket, may be disposed between the plenum portion 52 and the runner assembly 54, and between the plenum portion 52, the runner assembly 54, and the end plate 57. The sealing means is effective to provide a fluid tight seal between the plenum portion 52 and the runner assembly 54, and between the plenum portion 52, the runner assembly 54, and the end plate 57.

In the embodiment illustrated in FIG. 2, the runner assembly 54 and the end plate 57 are shown as separate components. It will be understood however, that the runner assembly 54 and the end plate 57 can be manufactured as a single piece.

In the embodiments illustrated in FIGS. 1 and 2, the runner assembly 14, 54 is secured or joined to the plenum portion 12, 52 with threaded fasteners. Alternatively, the runner assembly 14, 54 can be secured to the plenum portion 12, 52 by other methods if so desired. For example, the runner assembly 14, 54 and the plenum portion 12, 52 can be mechanically joined during an in situ molding process to thereby form an "overmolded" intake manifold assembly 10, 50. As used herein, the term overmolded defines an assembly wherein the runner assembly 14, 54 is permanently connected or joined to the plenum portion 12, 52 during the molding process to form an integrally joined intake manifold assembly 10, 50. Preferably, such a molding process would involve molding or forming a plastic runner assembly 14, 54 to a preformed metal (or non-metal) plenum portion 12, 52.

In the embodiments illustrated in FIGS. 1 and 2, the runner assembly 14, 54 is described as being manufactured as a single piece. It will be understood however, that the runner assembly 14, 54 can manufactured in more than one piece.

The combination of a metal plenum portion 12, 52 with a polymer runner assembly 14, 54 provides an intake manifold assembly 10, 50 with advantages heretofore unachievable with known intake manifolds. For example, forming the plenum portion from metal such as aluminum or magnesium provides improved noise suppression properties.

Additionally, forming the runner assembly from a polymer such as nylon provides runners wherein the interior surfaces are smoother than can be provided with cast metal runners. Runners with such smooth interior surfaces provide improved airflow with reduced air resistance, drag, and turbulence. Additionally, the runner assembly may be formed such that the runners are more compact and have a shorter length than known runners.

The principle and mode of operation of this invention have been described in its various embodiments. However, it should be noted that this invention may be practiced otherwise than as specifically illustrated and described without departing from its scope.

What is claimed is:

1. An air intake manifold assembly for use with an internal combustion engine, the air intake manifold assembly comprising:

a plenum portion;

a runner assembly mounted to said plenum portion, said runner assembly having a flange disposed between an air intake portion and an air outlet portion;

wherein said runner assembly includes a plurality of runners extending outward of said flange, each of said runners having an air intake portion and an air outlet portion, and wherein said flange includes a plenum mounting surface for mounting said flange to said plenum portion, and a cylinder head mounting surface for mounting said flange to a cylinder head of an internal combustion engine.

2. The air intake manifold assembly according to claim 1, wherein said plenum portion is formed from a first material and said runner assembly is formed from a second material different from said first material.

3. The air intake manifold assembly according to claim 1, wherein said plenum portion includes an air intake port, an air chamber, and a runner mounting surface defining a plenum opening into said air chamber, and wherein said flange includes a first surface and a second surface opposite said first surface.

4. The air intake manifold assembly according to claim 3, wherein said runner assembly includes a plurality of first runner portions extending outward of said first surface, and a plurality of second runner portions extending outward of said second surface.

5. The air intake manifold assembly according to claim 4, wherein said first runner portions define air intake ports, and said second runner portions define air outlet ports.

6. The air intake manifold assembly according to claim 4, wherein said flange of said runner assembly is mounted to said plenum portion about said plenum opening, such that said first runner portions are disposed within said air chamber.

7. The air intake manifold assembly according to claim 5, wherein said plenum opening is a first plenum opening into said air chamber, wherein said runner mounting surface includes a plurality of runner-receiving surfaces defining said first plenum opening, and wherein said plenum portion further includes a second plenum opening.

8. The air intake manifold assembly according to claim 7, wherein said runner assembly includes a plurality of first runner portions extending outward of said first surface, and a plurality of second runner portions in said second surface.

9. The air intake manifold assembly according to claim 8, wherein said second runner portions extend outward of said second surface.

10. The air intake manifold assembly according to claim 8, wherein said flange further includes a pair of slide grooves for mounting said flange to said plenum portion, said runner-receiving surfaces being disposed within said slide grooves, and wherein said second surface defines a cylinder head mounting surface for mounting said flange to a cylinder head of an internal combustion engine.

11. The air intake manifold assembly according to claim 8, wherein said first runner portions define air intake ports, and said second runner portions define air outlet ports.

12. The air intake manifold assembly according to claim 8, wherein said flange of said runner assembly is mounted to said plenum portion within said first plenum opening, such that said first runner portions are disposed within said air chamber.

13. The air intake manifold assembly according to claim 12, further including an end plate mounted to said plenum portion about said second plenum opening, said end plate defining a closure for said second plenum opening.

14. An air intake manifold assembly for use with an internal combustion engines the air intake manifold assembly comprising:

a plenum portion;

a runner assembly mounted to said plenum portion, said runner assembly having a flange disposed between an air intake portion and an air outlet portion;

wherein said plenum portion includes an air intake port, an air chamber, and a runner mounting surface defining a plenum opening into said air chamber, wherein said flange includes a first surface and a second surface opposite said first surface, wherein said runner assembly includes a plurality of first runner portions extending outward of said first surface, and a plurality of second runner portions extending outward of said second surface, and wherein said first surface defines a plenum mounting surface for mounting said flange to said plenum portion, and said second surface defines a cylinder head mounting surface for mounting said flange to a cylinder head of an internal combustion engine.

15. An air intake manifold assembly for use with an internal combustion engine, the intake manifold assembly comprising:

a plenum portion; and a runner assembly having a flange disposed between an air intake portion and an air outlet portion, wherein said flange has a plenum mounting surface for mounting said flange to said plenum portion, and a cylinder head mounting surface opposite said plenum mounting surface for mounting said flange to a cylinder head of an internal combustion engine, wherein said air intake portion includes a plurality of first runner portions extending outward of said plenum mounting surface, and said air outlet portion includes a plurality of second runner portions extending outward of said cylinder head mounting surface, and wherein said flange of said runner assembly is mounted to said plenum portion.

16. An air intake manifold assembly for use with an internal combustion engine, the intake manifold assembly comprising:

a plenum portion;

a runner assembly having a flange disposed between an air intake portion and an air outlet portion, wherein said flange has a pair of slide grooves form therein for slidably mounting said runner assembly to said plenum portion, an air intake surface, and a cylinder head mounting surface for mounting said flange to a cylinder head of an internal combustion engine, wherein said air intake portion includes a plurality of first runner portions extending outward of said air intake surface, and said air outlet portion includes a plurality of second runner portions in said cylinder head mounting surface, and wherein said flange of said runner assembly is mounted to said plenum portion;

a plenum closure mounted to said plenum portion and securing said runner assembly to said plenum portion.

* * * * *